US007980406B2

(12) United States Patent
Liu

(10) Patent No.: US 7,980,406 B2
(45) Date of Patent: Jul. 19, 2011

(54) CONTAINER ASSEMBLY

(76) Inventor: Ivan Liu, Taichung (TW)

( * ) Notice: Subject to any disclaimer, the term of this patent is extended or adjusted under 35 U.S.C. 154(b) by 397 days.

(21) Appl. No.: 12/169,558

(22) Filed: Jul. 8, 2008

(65) Prior Publication Data

US 2010/0006582 A1 Jan. 14, 2010

(51) Int. Cl.
*B65D 25/00* (2006.01)
*A47G 19/00* (2006.01)

(52) U.S. Cl. .... 220/23.4; 220/737; 220/738; 220/23.83; 220/23.2

(58) Field of Classification Search ..... 220/737, 220/23.83, 738, 23.2, 23.4; 248/311.2, 312, 248/312.1; 206/216, 217
See application file for complete search history.

(56) References Cited

U.S. PATENT DOCUMENTS

| | | | | | |
|---|---|---|---|---|---|
| D139,569 | S | * | 11/1944 | O'Brien | D32/53 |
| 3,693,923 | A | * | 9/1972 | Ayoub et al. | 248/690 |
| 4,183,444 | A | * | 1/1980 | English et al. | 220/200 |
| 4,491,220 | A | * | 1/1985 | Daviss | 206/217 |
| 4,620,631 | A | * | 11/1986 | Bartelt | 206/217 |
| 4,854,466 | A | * | 8/1989 | Lane, Jr. | 220/23.83 |
| 4,993,671 | A | * | 2/1991 | Ste. Marie | 248/113 |
| 5,429,262 | A | * | 7/1995 | Sharkey | 220/23.83 |
| 5,482,095 | A | * | 1/1996 | de Chollet | 141/380 |
| 5,775,570 | A | * | 7/1998 | Kim | 229/4.5 |
| 6,152,362 | A | * | 11/2000 | Rosenfeld | 229/400 |
| 6,230,969 | B1 | * | 5/2001 | Spransy | 229/400 |
| 6,257,441 | B1 | * | 7/2001 | Maley | 220/840 |
| 6,360,944 | B1 | * | 3/2002 | Gorman | 229/400 |
| 6,386,443 | B1 | * | 5/2002 | Szczerbinski | 229/400 |
| 6,394,265 | B1 | * | 5/2002 | Tsao | 206/217 |
| 6,394,297 | B1 | * | 5/2002 | Nance | 220/23.4 |
| 6,419,153 | B1 | * | 7/2002 | Maita | 229/400 |
| 6,460,722 | B2 | * | 10/2002 | Lee | 220/592.16 |
| 6,612,485 | B2 | * | 9/2003 | Lackner et al. | 229/400 |
| 6,651,947 | B1 | * | 11/2003 | Price | 248/311.2 |
| 6,719,192 | B2 | * | 4/2004 | Barcat et al. | 229/400 |
| RE38,652 | E | * | 11/2004 | Provost | 24/452 |
| 6,925,690 | B2 | * | 8/2005 | Sievers | 24/599.1 |
| 7,237,687 | B1 | * | 7/2007 | Abdi et al. | 211/119.004 |

* cited by examiner

*Primary Examiner* — Anthony Stashick
*Assistant Examiner* — Kareen Rush
(74) *Attorney, Agent, or Firm* — DLA Piper LLP (US)

(57) ABSTRACT

A container assembly includes a first container, a second container, and a connecting unit. The first container has an opening and a rim that defines the opening. The second container has a wall formed with a slit unit. The connecting unit includes an upper hook section hooked removably onto the rim of the first container, a lower hook section extended removably through the slit unit for hooking the wall of the second container onto the lower hook section, and an intermediate section interconnecting the upper hook section and the lower hook section.

10 Claims, 5 Drawing Sheets

CONTAINER ASSEMBLY

BACKGROUND OF THE INVENTION

1. Field of the Invention

The invention relates to a container assembly, more particularly to a container assembly having a connecting unit for connecting two containers together.

2. Description of the Related Art

Many people who attend events, such as movies, sporting games, concerts and the like, would purchase beverages and food for enjoyment during the course of the events. FIG. 1 shows a user holding a beverage container 101 in one hand and a container 102 for French fries in his/her other hand. In the event where the user wants to eat the French fries, and due to the fact that both of his/her hands are occupied, the user must put down the container 101 first, so that he/she is able to free his/her other hand to pick up the French fries, which can be awkward and inconvenient.

Another common problem is that users generally do not desire to constantly hold the food or beverage products in both of their hands because this makes their hands immobilized to engage in other activities.

SUMMARY OF THE INVENTION

It is an object of the present invention to provide a container assembly that can overcome the above drawbacks of the prior art.

According to the present invention, a container assembly includes a first container, a second container, and a connecting unit. The first container has an opening and a rim that defines the opening. The second container has a wall formed with a slit unit. The connecting unit includes an upper hook section hooked removably onto the rim of the first container, a lower hook section extended removably through the slit unit for hooking the wall of the second container onto the lower hook section, and an intermediate section interconnecting the upper hook section and the lower hook section.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
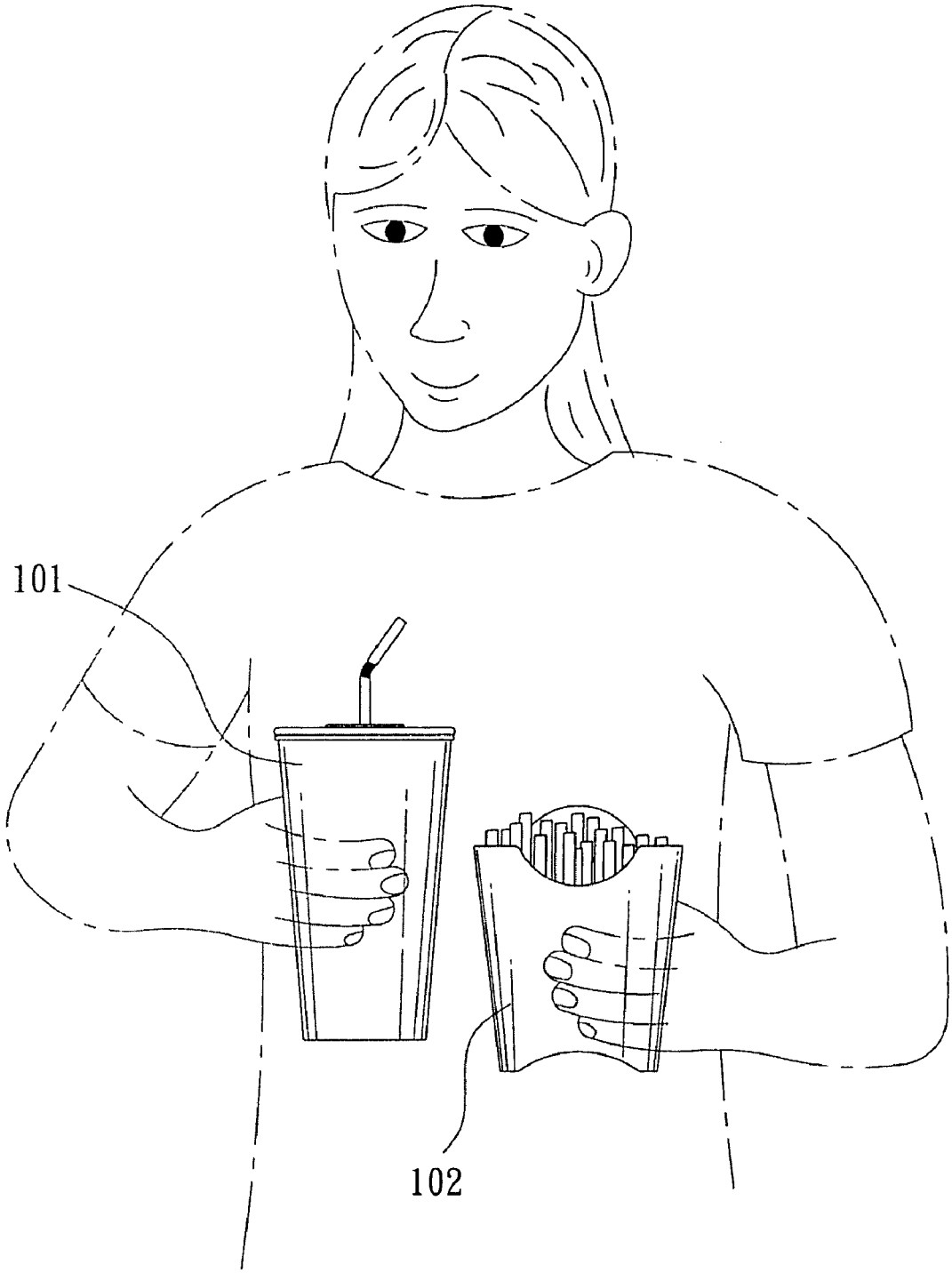
FIG. 1 PRIOR ART
FIG. 1 shows a user holding a beverage container in one hand and a container for French fries in the other hand.
Figure 2:
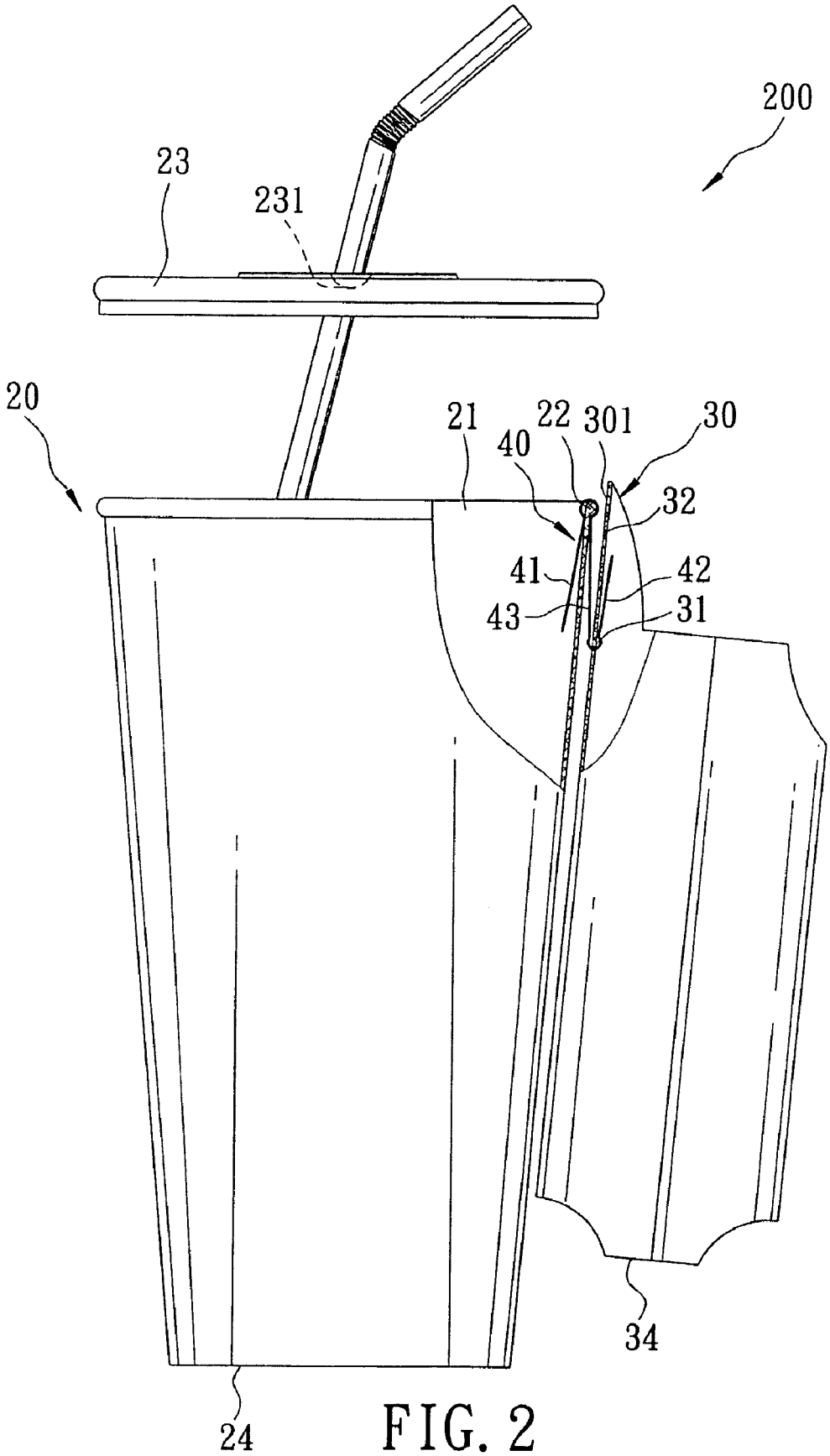
FIG. 2 is a side view showing the preferred embodiment of a container assembly according to the present invention.
Figure 3:
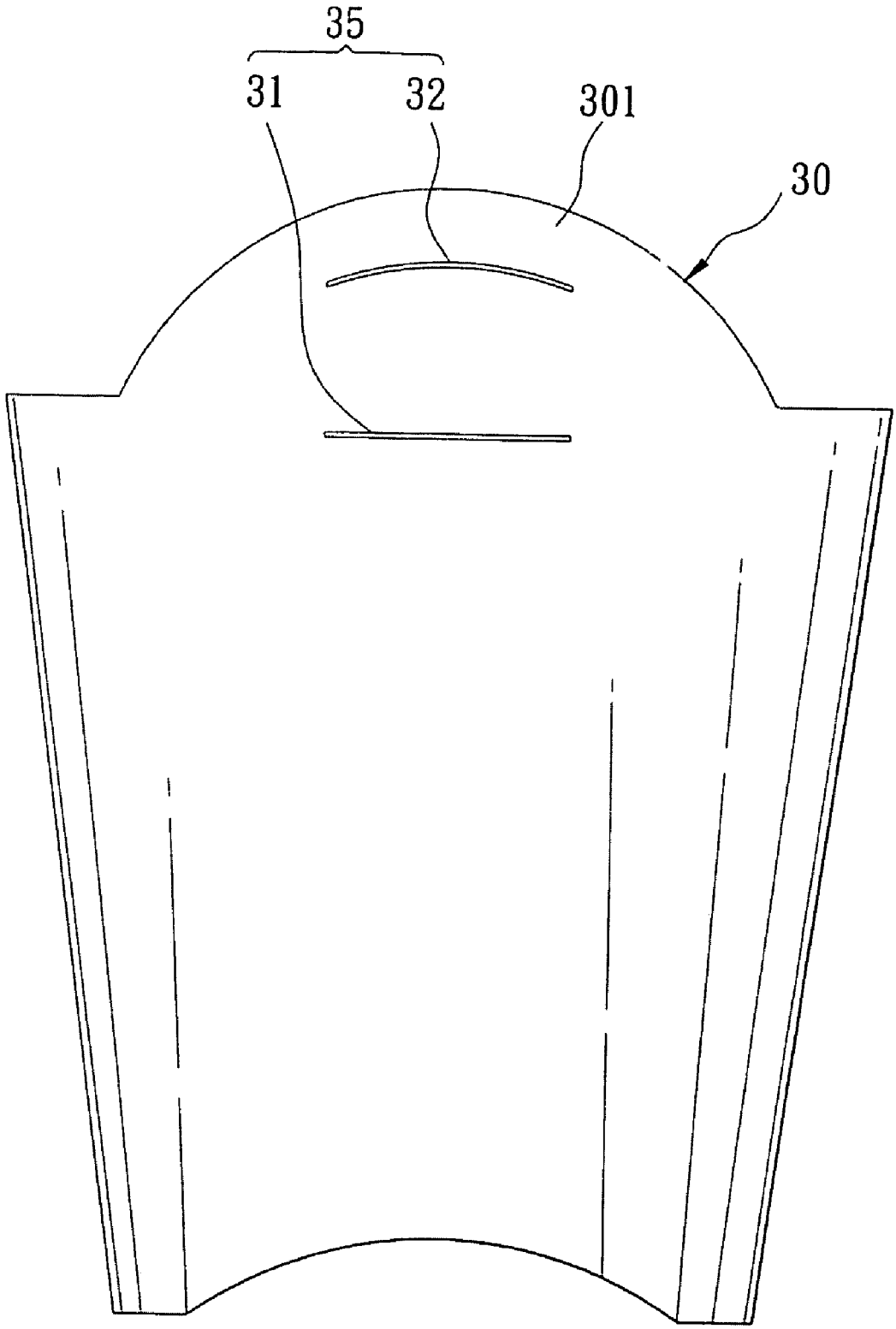
FIG. 3 shows a rear view of a second container of the container assembly according to the present invention.
Figure 4:
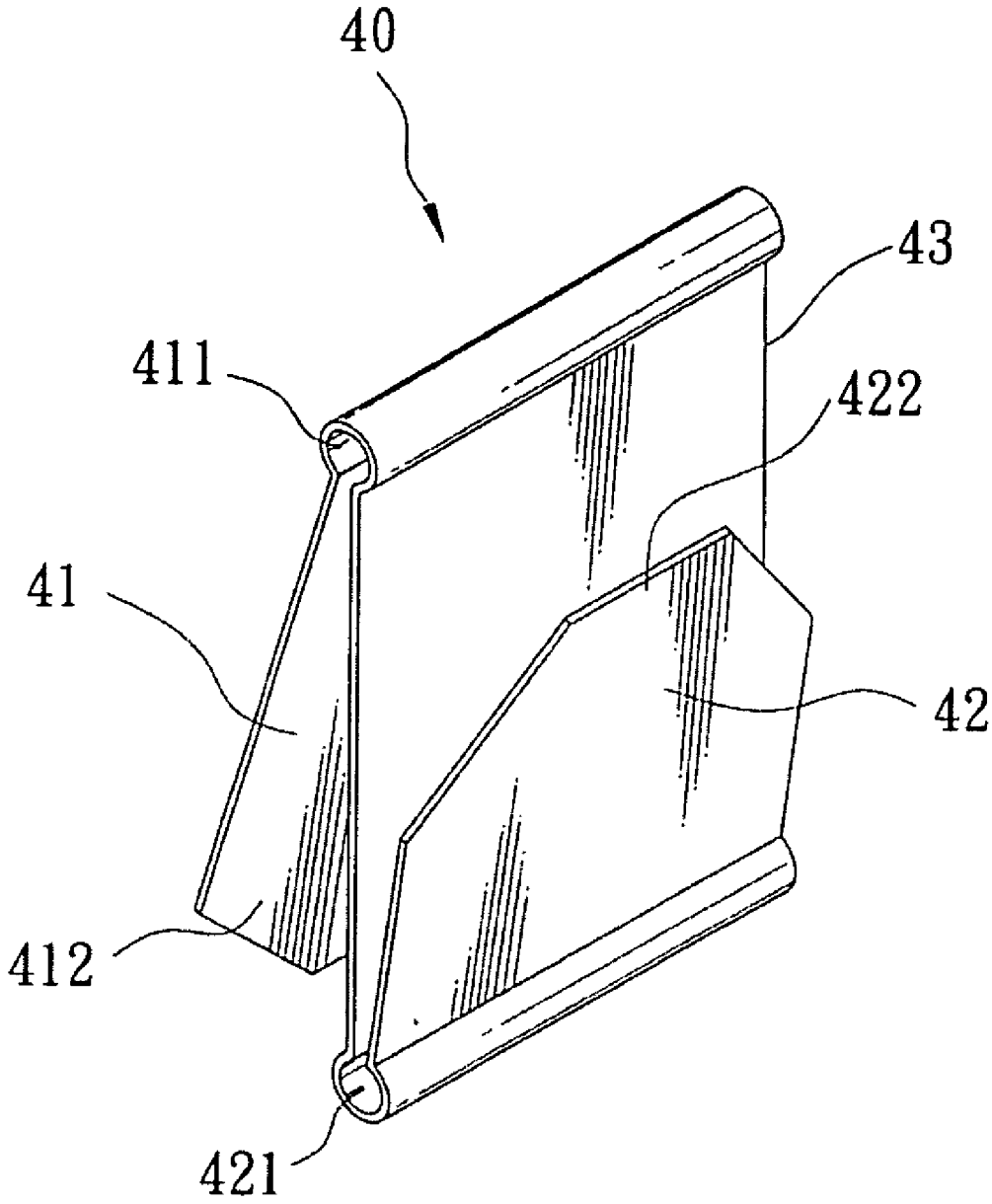
FIG. 4 is a perspective view of a connecting unit of the container assembly according to the present invention.

As shown in FIGS. 2, 3, and 4, the preferred embodiment of a container assembly 200 according to the present invention includes a first container 20, a second container 30, and a connecting unit 40. The first container 20 has an opening 21 and a rim 22 that defines the opening 21. The second container

30 has a wall 301 formed with a slit unit 35. The connecting unit 40 includes an upper hook section 41 hooked removably onto the rim 22 of the first container 20, a lower hook section 42 extended removably through the slit unit 35 for hooking the wall 301 of the second container 30 onto the lower hook section 42, and an intermediate section 43 interconnecting the upper hook section 41 and the lower hook section 42. The container assembly 200 also includes a lid 23 engaging removably the rim 22 for closing the opening 21 of the first container 20. The lid 23 is formed with a straw hole 231. The upper hook section 41 is retained between the lid 23 and the rim 22. The connecting unit 40 is formed integrally from a non-toxic plastic material that complies with applicable government regulation.

In this preferred embodiment, the first container 20 is a beverage container and the second container 30 is a food container. Particularly, the present invention is useful for allowing moviegoers to hold beverage and food using in one of his/her hands.

The upper hook section 41 of the connecting unit 40 is formed with a rim engaging portion 411 connected to the intermediate section 43 and engaging frictionally and removably the rim 22. The lower hook section 42 is formed with a wall engaging portion 421 connected to the intermediate section 43 and permitting extension of a peripheral portion of the slit unit 35 therein. The rim engaging portion 411 is configured to be fitted removably on the rim 22. The wall engaging portion 421 has a shape configured to match that of the peripheral portion of the slit unit 35. Preferably, the shape of the wall engaging portion 421 and the peripheral portion of the slit unit 35 is one of a linear shape and a curve shape.

The upper hook section 41 of the connecting unit 40 is further formed with an upper panel 412 that extends from the rim engaging portion 411, that forms another angle with the intermediate section 43, and that tapers in a direction away from the rim engaging portion 411. On the other hand, the lower hook section 42 is further formed with a lower panel 422 that extends from the wall engaging portion 421, that forms an angle with the intermediate section 43, and that tapers in a direction away from the wall engaging portion 421.

In this preferred embodiment, as illustrated in FIG. 2, each of the first and second containers 20, 30 has a container bottom 24, 34. The slit unit 35 includes a first slit 31 and a second slit 32 disposed above the first slit 31. To facilitate consumption of food and beverage by the user, the lower hook section 42 is extended through the first slit 31 for hooking the wall 301 of the second container 30 onto the lower hook section 42, thereby suspending the second container 30 from the first container 20 such that the container bottom 34 of the second container 30 is dispose at a level higher than the container bottom 24 of the first container 20 to facilitate retrieval of food from the second container 30.

Figure 5:
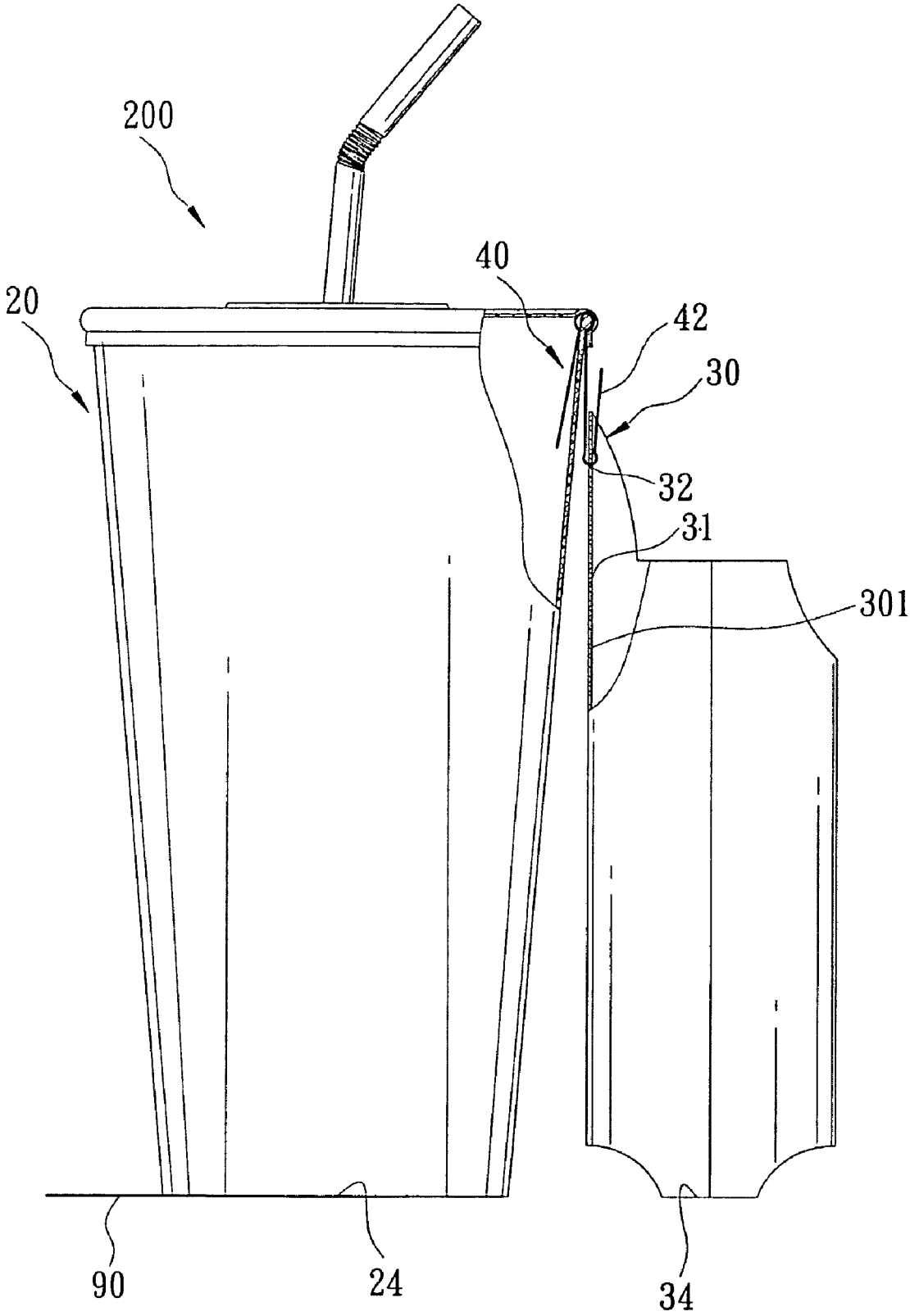
FIG. 5 is a side view of the container assembly, illustrating a connecting state where container bottoms of first and second containers of the container assembly are substantially coplanar.

On the other hand, in order to prevent toppling of the container assembly 200 when placed on a surface 90 (see FIG. 5), such as a table surface, the second slit 32 is disposed such that the container bottoms 24, 34 of the first and second containers 20, 30 are substantially coplanar when the lower hook section 42 is extended through the second slit 32 for hooking the wall 301 of the second container 30 onto the lower hook section 42, as best shown in FIG. 5. In this manner, the first and second containers 20, 30 are stably disposed on the surface 90.

The present invention can be used as described above, to provide the user a chance to use one of his/her hands for holding the container assembly 200 while at the same time freeing his/her other hand to engage in other activities, e.g., picking French fries from the container assembly 200 or holding a movie ticket.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A container assembly comprising:

a first container having an opening and a rim that defines said opening;

a second container having a wall formed with a slit unit; and a connecting unit including an upper hook section hooked removably onto said rim of said first container, a lower hook section extended removably through said slit unit for hooking said wall of said second container onto said lower hook section, and an intermediate section interconnecting said upper hook section and said lower hook section, wherein each of said first and second containers has a container bottom, said slit unit including a first slit and a second slit disposed above said first slit, said first slit being disposed such that said container bottom of said second container is at a level higher than said container bottom of said first container when said lower hook section is extended through said first slit for hooking said wall of said second container onto said lower hook section, said second slit being disposed such that said container bottoms of said first and second containers are substantially coplanar when said lower hook section is extended through said second slit for hooking said wall of said second container onto said lower hook section.

2. The container assembly as claimed in claim 1, further comprising a lid engaging removably said rim for closing said opening of said first container, said lid being formed with a straw hole, said upper hook section being retained between said lid and said rim.

3. The container assembly as claimed in claim 1, wherein said upper hook section of said connecting unit is formed with a rim engaging portion connected to said intermediate section and engaging frictionally and removably said rim, and said lower hook section is formed with a wall engaging portion connected to said intermediate section and permitting extension of a peripheral portion of said slit unit therein.

4. The container assembly as claimed in claim 3, wherein said upper hook section of said connecting unit is further formed with an upper panel that extends from said rim engaging portion and that forms an angle with said intermediate section, said lower hook section being further formed with a lower panel that extends from said wall engaging portion and that forms another angle with said intermediate section.

5. The container assembly as claimed in claim 4, wherein said upper panel tapers in a direction away from said rim engaging portion, and said lower panel tapers in a direction away from said wall engaging portion.

6. The container assembly as claimed in claim 3, wherein said rim engaging portion is configured to be fitted removably on said rim.

7. The container assembly as claimed in claim 3, wherein said wall engaging portion has a shape configured to match that of said peripheral portion of said slit unit.

8. The container assembly as claimed in claim 7, wherein the shape of said wall engaging portion and said peripheral portion of said slit unit is one of a linear shape and a curve shape.

9. The container assembly as claimed in claim 1, wherein said connecting unit is formed integrally from a non-toxic plastic material.

10. The container assembly as claimed in claim 1, wherein said first container is a beverage container and said second container is a food container.

* * * * *